United States Patent [19]

Morgan

[11] 4,004,478

[45] Jan. 25, 1977

[54] APPARATUS FOR ADJUSTING THE POSITION OF A ROTATABLE CUTTER MECHANISM

[75] Inventor: Gaylard M. Morgan, Saxton, Pa.

[73] Assignee: F. L. Smithe Machine Company, Inc., Duncansville, Pa.

[22] Filed: Jan. 20, 1976

[21] Appl. No.: 650,630

[52] U.S. Cl. ..... 83/331; 83/343; 83/355; 74/397

[51] Int. Cl.[2] ..... B26D 1/56

[58] Field of Search ..... 83/321, 328, 343, 345, 83/354, 355, 356.3, 331; 74/395, 396, 397

[56] References Cited

UNITED STATES PATENTS

| | | | |
|---|---|---|---|
| 3,067,643 | 12/1962 | Ward, Jr. | 83/345 X |
| 3,084,582 | 4/1963 | Anderson | 83/345 X |
| 3,166,947 | 1/1965 | Hendershot | 74/395 X |
| 3,683,875 | 8/1972 | Chadwick | 74/395 X |
| 3,869,948 | 3/1975 | Rau | 83/345 X |

*Primary Examiner*—Willie G. Abercrombie
*Attorney, Agent, or Firm*—Stanley J. Price, Jr.; John M. Adams

[57] ABSTRACT

A shaft for a cutter mechanism having a cutter blade secured to the periphery thereof is rotatably mounted in a frame mechanism. A driven pulley is nonrotatably secured to the end of the cutter shaft and is connected to a pair of drive pulleys by a flexible timing belt that transmits rotation to the cutter shaft and the cutter blade. Rotation of the cutter blade cuts notches in the side edges of a moving web. A plate member is pivotally connected to the frame mechanism and includes an aperture through which the cutter shaft extends. An adjusting cam is eccentrically mounted to the frame mechanism and is secured to the plate member. A pair of idler shafts are secured to the plate member and extend outwardly therefrom. A pair of idler pulleys are rotatably positioned on the idler shafts respectively and engage the timing belt to maintain a preselected tension thereon. Rotation of the adjusting cam through a preselected angle pivots the plate member and the idler pulleys through a corresponding angle on the frame mechanism relative to the cutter shaft. Pivotal movement of the idler pulleys turns the timing belt to rotate the driven pulley and cutter shaft in preselected direction through a preselected angle. Rotation of the cutter shaft rotates the cutter blade to provide a change in the phase relationship between the cutter blade and the moving web to be cut while the cutter mechanism is operating or static.

9 Claims, 6 Drawing Figures

APPARATUS FOR ADJUSTING THE POSITION OF A ROTATABLE CUTTER MECHANISM

BACKGROUND OF THE INVENTION

1. Field of the Invention

This invention relates to apparatus for adjusting the position of a rotatable cutter mechanism and more particularly to apparatus for turning the timing belt of the drive mechanism to angularly displace the driven pulley of the cutter shaft in a preselected direction to change the angular position of the cutter blade with respect to a moving web to be cut.

2. Description of the Prior Art

Cutter mechanisms for cutting notches of a selected length in a moving web as illustrated and described in U.S. Pat. No. 3,782,233 disclose a pair of rotatable cutting knives that are positioned on opposite sides of the web. The cutting knives are nonrotatably secured to rotatable shafts that are mounted on a platform connected through coupling devices to gear boxes that are drivingly connected to a common drive shaft.

It is essential that in forming the side edges of the seal flap and the bottom flap of the envelope blank to be formed from the web that the cutting knives on opposite sides of the web rotate in timed relationship to each other so that the notches cut in the web are cut at the same transverse location on the web. If the rotating knives should be out of phase, the notches formed on opposite sides of the web will not be symmetrical and an adjustment in the phase relationship of the cutting knives is required to accurately cut notches in the moving web. Adjusting the relative position of the cutting knives so that the cutting sequence of the knives be in phase or coordinated so that the notches be oppositely positioned is accomplished by either disengaging the cutter shaft from the driven pulley and rotating the cutter shaft through the required angular displacement to provide the proper register between the cutter shafts or to drivingly connect the driven pulley to the drive pulley by relatively complex gearing in order to change the timing of the cutter shaft. Because the known rotating blade-type cutters are mechanically connected to a common drive shaft, it is not possible to adjust the phase relationship between the cutting knives while the web is moving and the cutter mechanism is operating.

There is need for apparatus to adjust the phase relationship of the cutting knives of a rotatable cutter mechanism for cutting notches in the opposite sides of a moving web. While it has been suggested by the prior art systems to adjust the relative position of the cutter knives with respect to the web so that the knives cut the web at the same transverse location, complex gearing connecting the drive shaft to the cutter shaft is required. Furthermore, it is not possible to perform the phase adjustment without either disconnecting the driven pulley from the cutter shaft or stopping movement of the web.

SUMMARY OF THE INVENTION

In accordance with the present invention, there is provided apparatus for adjusting the position of a rotatable cutter mechanism that includes a frame member and a cutter shaft rotatably mounted in the frame member. A driven pulley is nonrotatably connected to one end of the cutter shaft and extends through an aperture in a plate member that is pivotally connected to the frame member. A drive mechanism is drivingly connected to the driven pulley for rotating the driven pulley at a preselected speed. A rotatable device is secured to the plate member and is engaged to the drive mechanism. The rotatable device rotates the drive mechanism to, in turn, rotatably displace the driven pulley upon pivotal movement of the plate member to move the cutter shaft through a preselected angular displacement.

The plate member is pivotted in a preselected direction on the frame member by an adjusting device that is supported by the frame member and secured to the plate member. Rotation of the adjusting device effects pivotal movement of the plate member about the connection thereof to the frame member. The adjusting device includes a cam member that is eccentrically mounted for rotation on the frame member and is nonrotatably secured to the plate member within a slot thereof.

The drive mechanism for rotating the driven pulley at a preselected speed includes a pair of drive pulleys nonrotatably secured to drive shafts in which a selected one of the shafts is rotated by a conventional motor. An endless flexible timing belt is reeved about the drive pulleys and the driven pulley and transmits rotation from the drive shafts to the driven pulley to thereby rotate the cutter shaft.

The rotatable mechanism mounted on the pivotal plate member effects displacement of the timing belt in a preselected direction to, in turn, displace the driven pulley and cutter shaft in a preselected direction through an angle corresponding to the displacement of the timing belt. The rotatable mechanism includes a pair of idler shafts that are secured to the pivotal plate member and are movable therewith. Idler pulleys are rotatably supported on the idler shafts and exert a preselected tension on the timing belt. Angular displacement of the plate member by selected rotation of the cam adjusting mechanism moves the idler pulleys through an arc to turn the timing belt and, thereby, rotate the driven pulley through a corresponding angle. Rotation of the driven pulley is transmitted through the cutter shaft to the cutter blade and results in an angular displacement of the cutter blade by which the position of the cutter blade in relationship to the moving web to be cut is changed.

Accordingly, the principal object in the present invention is to provide an apparatus for adjusting the position of a rotatable cutter mechanism by selectively displacing the flexible timing belt that transmits rotation from the drive mechanism to the driven pulley of the cutter shaft.

Another object of the present invention is to provide an adjusting apparatus for changing the position of a cutter blade on a rotatable cutter shaft with respect to a continuously moving web to be cut by pivotal movement of idler rollers relative to the cutter shaft to turn the timing belt of the drive mechanism in a preselected direction and rotate the driven pulley to rotate the cutter shaft and cutter blade through a preselected angle in a preselected direction.

A further object of the present invention is to provide apparatus for adjusting the angular position of a cutter blade on a rotatable cutter mechanism by movement of the flexible timing belt in a preselected direction to rotate the driven pulley of the cutter shaft through a preselected angle without requiring disengagement of the driven pulley from the cutter shaft and additional gearing for effecting adjustments in the angular position of the cutter blade with respect to the moving web to be cut.

These and other objects of the present invention will be more completely described and disclosed in the following specification, the accompanied drawings and the appended claims.

DESCRIPTION OF THE PREFERRED EMBODIMENTS

Figure 1:
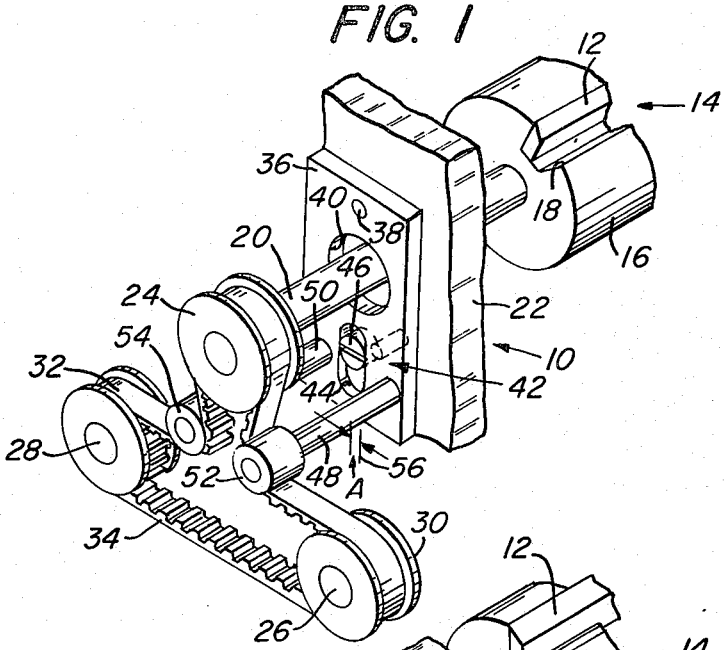
FIG. 1 is an isometric view of an apparatus for adjusting the position of a rotatable cutter mechanism, illustrating the cutter blade of the mechanism rotated in a clockwise direction through a preselected angle by pivotal movement of the plate member.
Figure 2:
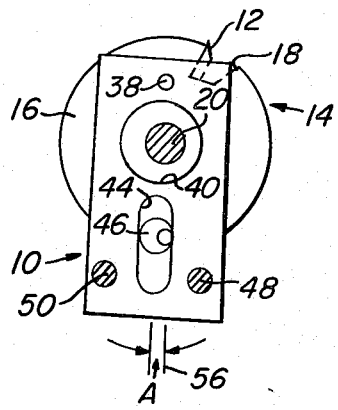
FIG. 2 is a sectional view in side elevation of the adjusting apparatus shown in FIG. 1, illustrating the angular displacement of the cutter blade effected through pivotal movement of the plate member.

Referring to the drawings and particularly to FIGS. 1 and 2, there is illustrated adjusting apparatus generally designated by the numeral 10 for angularly displacing a cutter blade 12 of a rotatable cutter mechanism 14 relative to a moving web (not shown) to be cut. The rotatable cutter mechanism 14 is similar to that illustrated and described in U.S. Pat. No. 3,782,233 and includes a shaft 16 having a longitudinal recess 18 positioned on the periphery of the shaft 16. The cutter blade 12 is secured to the shaft 16 within the recess 18 and is thus rotatable with the shaft 16. A pair of the rotatable cutter mechanisms 14 having cutter blades 12 positioned on opposite sides of a moving web are operable to cut notches in the sides of the endless web as it is fed between the shafts 16 of the rotatable cutter mechanisms. In accordance with the present invention, the adjusting apparatus 10 maintains the cutter blades 12 in correct alignment and proper phase relationship so that the cutter blades cut the web at the same time to form the desired notch on opposite sides of the moving web.

One of the principal features of the above described cutter mechanism 14 is to form the side edges of the seal flap and bottom flap of adjacent envelope blanks that are severed from the web. It is, therefore, essential in forming the side edges of the seal flap and bottom flap that the cutter mechanisms positioned on opposite sides of the web be in correct alignment or phase register so that the side edges of the bottom flap, for example, on opposite sides of the web are cut at the same transverse location of the web. The alignment of the cutter mechanisms on opposite sides of the web is essential to obtain accurate and symmetrical envelope blanks. Furthermore, it is also necessary to control the speed of the cutter mechanisms so that the cutter blades are coordinated with the remaining components of the envelope-making machine.

The cutter shaft 16 has an end portion 20 that is rotatably mounted in a frame mechanism 22 of the envelope-making machine. A driven pulley 24 is nonrotatably secured to the shaft 16 to rotate therewith. A pair of shafts 26 and 28 are rotatably supported in the frame portion of the envelope machine, and the supports are not illustrated in the figures but are conventional in design. Pulley members 30 and 32 are secured to the shafts 26 and 28 respectfully and are rotatable therewith. An endless, flexible timing belt 34 is reeved about the pulleys 30 and 32 and around the driven pulley 24. A conventional motor is drivingly connected to one of the shafts 26 or 28 to rotate the respective pulleys 30 and 32 at a preselected speed relative to the remaining components of the envelope-making machine. The timing belt is tensioned by the pulleys 30 and 32 and transmits rotation therefrom to the driven pulley 24 and the cutter shaft 16.

A plate member 36 is pivotally connected to the frame mechanism 22 by a pin member 38. The plate member 36 includes an aperture 40 through which the shaft end portion 20 extends. The diameter of the aperture 40 provides sufficient clearance between the shaft 20 and the plate member 36 to permit pivotal movement of the plate member 36 about the pin member 38 on the frame mechanism 22 relative to the shaft 20.

The plate member 36 includes an adjusting mechanism generally designated by the numeral 42 that is operable to pivotally displace the plate member 36 about its pivotal connection to the frame mechanism 22. The adjustment mechanism 42 includes a slot 44 in the plate 36 and a cam member 46 eccentrically mounted on the frame mechanism 22. The cam member is secured to the plate 36 in the slot 44. With this arrangement, rotation of the cam member 46 pivots the plate member 36 about the pin member 38 relative to the frame mechanism 22. Accordingly, the rotational movement of the cam member 46 determines the angular displacement of the plate 36 from its initial reference position.

Shaft members 48 and 50 are nonrotatably secured to the plate member 36 on opposite sides of the adjusting mechanism 42. Idler pulleys 52 and 54 are rotatably mounted on the shafts 48 and 50, respectively. The idler pulleys 52 and 54 abut the timing belt 34 and serve to maintain a preselected tension thereon. With this arrangement, the idler shafts 48 and 50 are movable with the plate member 36 so that the idler pulleys 52 and 54 move with the plate 36 and turn the timing belt 34 in the direction of movement of the plate 36. Rotation of the timing belt 34, in turn, rotates the driven pulley 24 through an arc that corresponds to the pivotal displacement of the plate member 36 on the frame mechanism 22. Thus, the phase relationship between the cutter blade 12 and the web (not shown) is adjustable to maintain symmetrical cutting of the notches in the side edges of the web.

Figure 3:
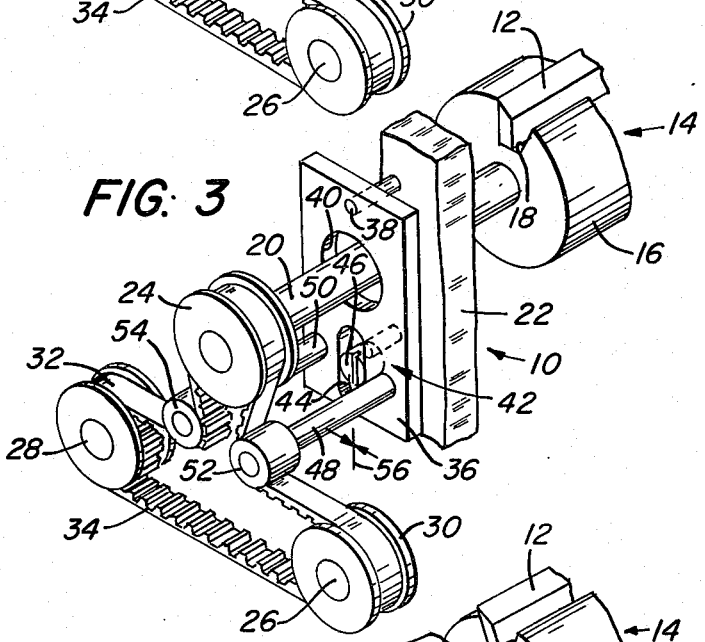
FIG. 3 is an isometric view of the adjusting apparatus, illustrating the cutter blade of the cutter mechanism aligned with the vertical axis of the machine frame.
Figure 4:
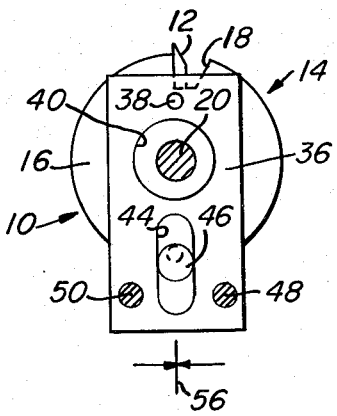
FIG. 4 is a sectional view of the adjusting apparatus illustrated in FIG. 3.
Figure 5:
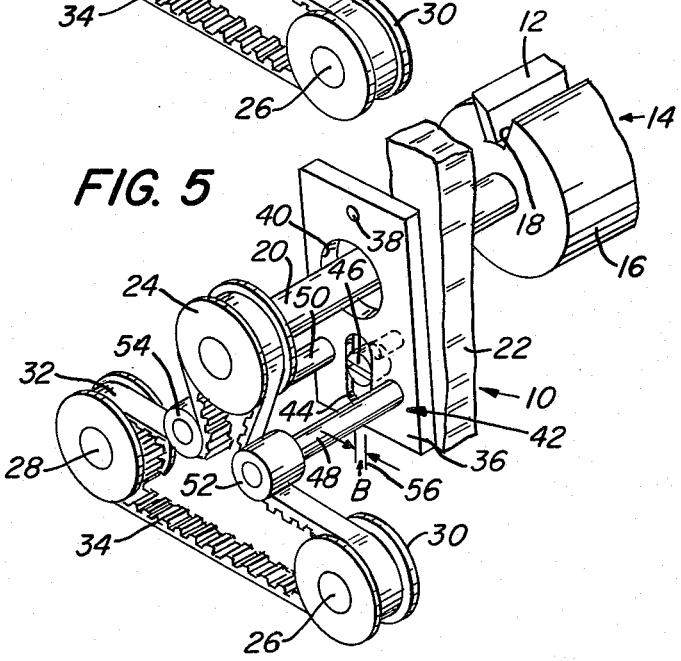
FIG. 5 is an isometric view of the adjusting apparatus, illustrating the cutter blade of the mechanism rotated in a counterclockwise direction upon pivotal movement of the plate member through a preselected angle from the vertical axis of the machine frame.

As illustrated in FIGS. 3 and 4, the eccentric adjusting mechanism 42 initially maintains the pivotal plate member 36 in a vertical alignment with the vertical axis 56 of the frame mechanism 22. With the plate member 36 maintained in alignment with the vertical axis 56 on the frame mechanism 22, the idler pulleys 52 and 54 turn the belt 34 to position the cutter blade 12 at an initial reference point where the cutter blade is aligned with the vertical axis 56. As illustrated in FIGS. 1 and 2 rotation of the cam member 46 in a clockwise direction about its eccentric mounting on the frame mechanism 22 pivots the plate member 36 about the pin 38 through a preselected angle A in a clockwise direction from the vertical axis 56. The pulleys 52 and 54 move with the plate member 36 through an arc of angle A.

Pivotal movement of the pulleys 52 and 54 turn the timing belt 34 which transmits the rotation to the driven pulley 24. The driven pulley 24 and the shaft end portion 20 also rotate in a clockwise direction to, in turn, rotate the cutter blade 12 in a clockwise direction through an angle corresponding to the angle of displacement A of the plate member 36 on the frame mechanism 22. Thus, by rotating the cam adjusting mechanism 42 through a preselected angle in a clockwise direction from the position illustrated in FIGS. 3 and 4, the cutter blade 12 on the rotatable shaft 16 is displaced by a corresponding angle to the position illustrated in FIGS. 1 and 2. The angular displacement of the cutter blade 12 is determined by the pivotal movement of the plate member 36 in response to the rotation of the eccentric cam 46. In this manner, phase adjustments of the position of the cutter blade 12 on the cutter shaft 16 may be made without disengaging the shaft end portion 20 from the driven pulley 24.

Figure 6:
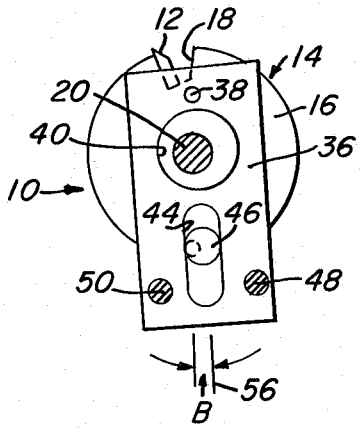
FIG. 6 is a sectional view of the adjusting apparatus illustrated in FIG. 5, illustrating the pivotal displacement of the plate member on the machine frame for adjusting the angular position of the cutter blade.

Counterclockwise adjustment in the angular position of the cutter blade 12 on the periphery of the cutter shaft 16 relative to the vertical axis 56 is accomplished by counterclockwise rotation of the adjusting cam member 46. Counterclockwise rotation of the cam member 46 from the position illustrated in FIG. 4 to the position illustrated in FIG. 6 pivots the plate member 36 on the pin member 38 through an angle B from the vertical axis 56. Accordingly, the idler pulleys 52 and 54 on the shafts 48 and 50 pivot through an arc of angle B with the plate member 36 and, thereby, rotate the belt 34 to, in turn, rotate the pulley 24 and the shaft 20 in a counterclockwise direction. The degree of rotation of the shaft 20 corresponds to the angle of displacement B of the plate member 36. In this manner, the cutter shaft 16 and cutter blade 12 are angularly displaced in a counterclockwise direction to effect the desired adjustment in the phase relationship between the cutter blade 12 and the web to be cut.

It will be apparent from the present invention that adjustments to the register and phase relation of the cutter mechanism 14 are made by displacing the timing belt 34 on the driven pulley 24 without the need of complicated gearing to connect the drive shaft of the cutter mechanism to the driven pulley 24. By selectively pivoting the plate member 36 on the frame mechanism 22, selective displacement of the timing belt 34 and driven pulley 24 is accomplished through movement of the idler pulleys 52 and 54 that are mounted on the plate 36. The simplicity of the adjusting apparatus 10 permits selected angular displacements in the radial position of the cutter blade 12 not only when the cutter mechanism 14 is static but when the mechanism is operating as well.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for adjusting the position of a rotatable cutter mechanism comprising, a frame member, a cutter shaft rotatably supported in said frame member, a driven pulley nonrotatably connected to one end portion of said cutter shaft, a plate member pivotally connected to said frame member and having an aperture through which said cutter shaft extends, said plate member having a slot therein, a cam member eccentrically mounted for rotation on said frame member, said cam member positioned in said slot of said plate member and secured thereto, said cam member arranged to rotate in a preselected direction through a preselected angle on said frame member and thereby pivot said plate member on said frame member in a corresponding direction and through a corresponding angle, drive means drivingly connected to said driven pulley for rotating said driven pulley at a preselected speed, and rotatable means secured to said plate member and engaged to said drive means for turning said drive means upon pivotal movement of said plate member to rotate said driven pulley through a preselected angle and thereby adjust the angular position of said cutter shaft relative to the moving web.

2. Apparatus for adjusting the position of a rotatable cutter mechanism as set forth in claim 1 which includes, adjusting means supported by said frame member and secured to said plate member for pivoting said plate member in a preselected direction about the pivotal connection thereof to said frame member.

3. Apparatus for adjusting the position of a rotatable cutter mechanism as set forth in claim 2 which includes, said adjusting means being rotatably supported by said frame member, and said plate member nonrotatably secured to said adjusting means such that rotation of said adjusting means in a preselected direction is transmitted to said plate member to pivot said plate member on said frame member.

4. Apparatus for adjusting the position of a rotatable cutter mechanism as set forth in claim 1 which includes, a pin member connecting said plate member to said frame member for pivotal movement thereon, said pin member extending through the upper end portion of said plate member above said aperture on the vertical axis of said plate member, said slot positioned in the lower end portion of said plate member below said aperture and aligned with the vertical axis of said plate member, and said cam member being centered in said slot and secured to said plate member such that rotation of said cam member pivots the lower end portion of said plate member about said pin member.

5. Apparatus for adjusting the position of a rotatable cutter mechanism as set forth in claim 1 in which said rotatable means includes, a pair of shaft members nonrotatably secured in spaced relation on the lower end portion of said plate member and extending outwardly therefrom to move with said plate member, an idler roller rotatably mounted on the end portion of each of said shaft members, and said idler rollers engaged to said drive means such that upon pivotal movement of said plate member said idler rollers turn said drive means and thereby rotate said driven pulley and said cutter shaft to change the phase register of said cutter mechanism.

6. Apparatus for adjusting the position of a rotatable cutter mechanism as set forth in claim 1 in which said drive means includes, a drive shaft rotatably mounted adjacent to said cutter shaft, a drive pulley nonrotatably connected to said drive shaft, an endless timing belt reeved about said drive pulley and said driven pulley and arranged to transmit rotation from said drive pulley to said driven pulley, and said rotatable means positioned on said plate member between said drive pulley and said driven pulley and arranged to control the tension on said timing belt.

7. Apparatus for adjusting the position of a rotatable cutter mechanism as set forth in claim 6 which includes, a second drive shaft rotatably mounted adjacent to said cutter shaft and spaced from said drive shaft, a second drive pulley nonrotatably connected to said second drive shaft, and said endless timing belt reeved around said drive pulley, said second drive pulley and said driven pulley with said rotatable means engaged to said endless timing belt such that pivotal movement of said plate member displaces said timing belt in a preselected direction to angularly displace said driven pulley to thereby adjust the phase register of the cutter mechanism.

8. Apparatus for adjusting the position of a rotatable cutter mechanism as set forth in claim 1 which includes, a cutter blade secured to the periphery of said cutter shaft for rotation therewith, said cutter blade arranged to cut notches in the moving web upon rotation of said cutter shaft, adjusting means supported by said frame member and secured to said plate member for pivoting said plate member and said rotatable means to angularly displace said driven pulley by turning said drive means, and said cutter shaft arranged to rotate in a preselected direction through a preselected angle upon displacement of said driven pulley to change the angular position of said cutter blade relative to the moving web.

9. Apparatus for adjusting the position of a rotatable cutter mechanism as set forth in claim 1 which includes, said aperture in said plate member having a diameter greater than the diameter of said cutter shaft such that said plate member is arranged to pivot on said frame member relative to said cutter shaft.

* * * * *